US005366839A

United States Patent [19]

Aoki

[11] Patent Number: 5,366,839

[45] Date of Patent: Nov. 22, 1994

[54] TONER FOR ELECTROSTATIC CHARGE IMAGE

[75] Inventor: Nobuyuki Aoki, Shimizu, Japan

[73] Assignee: Tomoegawa Paper Co., Ltd., Tokyo, Japan

[21] Appl. No.: 948,178

[22] Filed: Sep. 21, 1992

Related U.S. Application Data

[63] Continuation-in-part of Ser. No. 737,233, Jul. 29, 1991, abandoned.

[30] Foreign Application Priority Data

Aug. 3, 1990 [JP] Japan ..... 2-205098

[51] Int. Cl.[5] ..... G03G 9/081

[52] U.S. Cl. ..... 430/109; 430/110; 430/904

[58] Field of Search ..... 430/109, 110, 904; 524/517

[56] References Cited

U.S. PATENT DOCUMENTS

| | | | |
|---|---|---|---|
| 3,965,021 | 6/1976 | Clemens et al. | 252/62.1 P |
| 4,206,247 | 6/1980 | Mitsuhashi et al. | 430/120 |
| 4,442,189 | 4/1984 | Lu et al. | 430/45 |
| 4,686,257 | 8/1987 | Mitsuno et al. | 524/417 |
| 5,061,587 | 10/1991 | Tsubuko et al. | 430/110 |

*Primary Examiner*—Christopher D. Rodee

*Attorney, Agent, or Firm*—Wenderoth, Lind & Ponack

[57] ABSTRACT

A toner for an electrostatic charge image, which has improved preservation stability and improved fixing properties. The toner contains a binder resin and a colorant as main components and further contains from 1% by weight to less than 10% by weight, based on the total weight of the toner, of an ethylene-acrylic ester-maleic anhydride terpolymer resin.

5 Claims, No Drawings

TONER FOR ELECTROSTATIC CHARGE IMAGE

This application is a continuation-in-part of now abandoned patent application, Ser. No. 07/737,233 filed Jul. 29, 1991 abandoned.

FIELD OF THE INVENTION

The present invention relates to a toner for an electrostatic charge image. More specifically, it relates to a toner for an electrostatic charge image, which has improved fixing properties for use with a heat roll fixing-applied copying machine and which prevents scumming on the copy surface or the reverse surface of a paper sheet having a copied image on another surface (to be referred to as "copied document" hereinafter) when used with an automatic double-surface copying machine or with a copying machine equipped with an automatic document feeder.

BACKGROUND OF THE INVENTION

When a copy image is made with a copying machine, it is important that a toner has a fixing strength above a certain level when it is heat-fixed.

When double-surface copying is conducted, in particular, with an automatic double-surface copying machine or with a copying machine equipped with an automatic paper feeder, a scumming due to an insufficient fixing strength of a toner poses a big problem. Further, when a copy image is made on that surface of a copied document which has no copied image with a copy machine equipped with an automatic paper feeder, scumming caused on the reverse surface (which already has a copied image) by insufficient fixing strength of a toner is a big problem.

In order to overcome the above problems, it is conventional practice to use a toner containing a polyethylene-based wax, a natural wax such as carnauba wax, and ethylene-vinyl acetate copolymer, or the like.

In the above prior art toners containing a polyethylene-based wax, a natural wax, or the like, these waxes cause a variety of adverse effects, e.g., the wax unnecessarily adheres to an electrophotographic photoreceptor or a carrier surface to form a film due to defective dispersion of the wax in a binder resin or dissociation of the wax, so-called "filming"; the degree of fogging of a copy caused by the filming increases; and the like.

Further, when a toner contains an ethylene-vinyl acetate copolymer, the preservability of the toner is often liable to be deteriorated due to adhesion properties of the copolymer itself (such a toner powder blocks at a high temperature).

SUMMARY OF THE INVENTION

It is an object of the present invention to provide a toner for an electrostatic charge image, which has improved preservation stability and improved fixing properties.

It is another object of the present invention to provide a toner for an electrostatic charge image, which is suitable for use with a copying machine to which a heat-fixing method is applied.

It is further another object of the present invention to provide a toner for an electrostatic charge image, which is free from occurrence of a scum on a copy when the copy is made with a copying machine.

Further, it is another object of the present invention to provide a toner for an electrostatic charge image, which is free from the occurrence of a scum on a copy or a copied document when a copy image is made on a paper sheet or the reverse surface of the copied document with an automatic double-surface copying machine or with a copying machine equipped with an automatic document feeder.

According to the present invention, there is provided a toner for an electrostatic charge image, which contains a binder resin and a colorant as a main component and further contains 1 to less than 10% by weight, based on a total weight of the toner, of an ethylene-acrylic ester-maleic arthydride terpolymer resin.

DETAILED DESCRIPTION OF THE INVENTION

The present inventor has made a diligent study to overcome the above problems, and found that a toner prepared by incorporating 1 to less than 10% by weight of the above termpolymer resin into a toner containing a binder resin and a colorant as a main component has a high fixing strength and excellent double-surface copying properties and which is free from scumming when used with an automatic document feeder. In particular, it is preferred to use an ethylene-acrylic ester-maleic anhydride terpolymer having an acrylic ester content of 1 to 40% by weight based on the terpolymer weight.

When the above acrylic ester content is less than the above lower limit, the resultant toner becomes hard and fragile. As a result, the scratch resistance is deteriorated and the fixing strength decreases. When the acrylic ester content is more than the above upper limit, the toner becomes too soft. As a result, the scratch resistance is deteriorated and the fixing strength decreases.

The amount of the ethylene-acrylic ester-maleic anhydride terpolymer resin for use based on the total toner weight is 1 to less than 10% by weight. When this amount is less than the above lower limit, no improvement in the double-surface copying properties can be obtained, and it is impossible to prevent scumming with an automatic document feeder. When it is more than the above upper limit, the resultant toner is not practically usable due to deterioration of preservability.

The terpolymer resin used in the present invention preferably contains 55 to 98% by weight of ethylene, 1 to 40% by weight of acrylic ester and 1 to 5% by weight of maleic anhydride.

The acrylic ester as a component of the terpolymer resin refers to an acrylic ester having a lower alkyl group having 1 to 6 carbon atoms, preferably 1 to 4 carbon atoms. The acrylic ester is specifically selected from methyl acrylate, ethyl acrylate, n-propyl acrylate, isopropyl acrylate, n-octyl acrylate, n-butyl acrylate, isobutyl acrylate, 2-chloroethyl acrylatc, etc.

The binder resin and colorant used in the toner for an electrostatic charge image, provided by the present invention, will be explained hereinafter.

The binder resin is selected, for example, from styrenes such as polystyrene, poly-p-chlorostyrene, polyvinyl toluene, etc., and homopolymers of these styrenes having substituent(s); styrene-based copolymers such as a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl α-chloromethacrylate copolymer, a styrene-acrylonitrile copolymer, a styrene-vinyl methyl ether copolymer, a styrene-vinyl ethyl ether copolymer, a styrene-vinyl methyl ketone copolymer, a styrene-butadiene copolymer, a styrene-isobutylene copolymer, a styrene-acrylonitrile-indene copolymer, a styrene-maleic acid copolymer, a styrene-maleic ester copolymer, etc.; polymethyl methacrylate; polybutyl methacrylate; polyvinyl chloride; polyvinyl acetate; polyethylene; polypropylene; polyester; polyurethane; polyamide; an epoxy resin; polyvinyl butyral; polyamide; a polyacrylic acid resin; rosin; modified rosin; a terpene resin; a phenolic resin; an aliphatic or alicyclic hydrocarbon resin; an aromatic petroleum resin; chlorinated paraffin, paraffin wax. These binder resins may be used alone or in combination.

The colorant is selected, for example, from carbon black, Nigrosine dye (C.I. No. 50415B), Aniline Blue (C.I. No. 50405), Chalcoil Blue (C.I. No. azoec Blue 3), Chrome Yellow (C.I. No. 14090), Ultramarine Blue (C.I. No. 77103), du Pont Oil Red (C.I. No. 26105), Quinolinc Yellow (C.I. No. 47005), Methylene Blue Chloride (C.I. No. 52015), Phthalocyanine Blue (C.I. No. 74160), Malachite Green Oxalate (C.I. No. 42000), Lamp Black (C.I. No. 77266), Rose Bengal (C.I. No. 45435), etc., and mixtures of these. It is required to incorporate the colorant in such an amount that a visible image having a sufficient density can be formed. In general, the amount of the colorant for use per 100 parts by weight of the binder resin is approximately in the range of 1 to 20% by weight.

Further, the toner of the present invention may contain a variety of other additives, e.g., a charge control agent, an offset preventer used in a contact heat fixing method, and the like. As an offset preventer, for example, preferred is a polyolefin having a softening point, measured by a ring and ball method, of 80° to 180° C., and particularly preferred is polypropylene.

The present invention can be also applied to monocomponent toner containing a magnetic substance. In this case, the magnetic substance is selected from ferromagnetic metals such as ferrite, magnetite, iron, cobalt, nickel, etc., alloys or compounds containing these; alloys which contain no ferromagnetic elements but exhibit ferromagnetism after a proper heat treatment such as manganese-copper-aluminum alloy, manganese-copper-tine alloy, etc., which contain manganese and copper and are called Heusler alloys; chromium dioxide; and the like. The magnetic substance used in the present invention is a fine powder having an average particle diameter of 0.1 to 1 micron. The magnetic substance is homogeneously dispersed in the binder resin. The amount of the magnetic substance for use per 100 parts by weight of the toner is 20 to 70 parts by weight, preferably 40 to 70 parts by weight.

According to the present invention, there is provided a toner for an electrostatic charge image, which can simultaneously overcome the problems on preservability and fixing properties of a toner, which have existed for many years, without having any adverse effect on image properties.

Further, according to the present invention, there is provided a toner for an electrostatic charge image, which is suitable for use with an automatic double-surface copying machine or with a copying machine equipped with an automatic paper feeder.

The present invention will be explained further in detail hereinafter by reference to Examples.

EXAMPLE 1

100 Parts of a styrene-acrylic ester copolymer resin having Mn of 5,500, Mw of 220,000 and Mw/Mn of 40 as a binder resin, 1.4 parts by weight of a charge control agent (Bontron NO4, trade name, supplied by Orient Chemical Co., Ltd.), 12 parts by weight of a colorant (carbon black MA-100, supplied by Mitsubishi Kasei Corp.) and 5 parts by weight of an ethylene-ethyl acrylate-maleic arthydride terpolymer (trade name "Bondine HX-8200", supplied by Sumika CDF Chemical Co., Ltd.) having an ethylene content of 91%, an ethyl acrylate content of 5.7% and a maleic anhydride content of 3.3% and having a Vicat softening point of 74° C. and a melting point of 102° C., as another binder resin were mixed. In addition, in this Examples and the other Examples, the Vicat softening point was measured according to JIS K6730, and the melting point was measured by differential scanning calorimetry. The resultant mixture was melt-kneaded, pulverized and classified to give a toner for an electrostatic charge image, which had an average particle diameter of 11 μm. 3 Parts of this toner were fully mixed with 100 parts by weight of a carrier obtained by coating a ferrite with a silicone resin, whereby a two-component toner was obtained.

EXAMPLE 2

Example 1 was repeated except that the ethylene-ethyl acrylate-maleic anhydride terpolymer was changed from 5 parts by weight of the Bondine HX8200 to 5 parts by weight of an ethylene-ethyl acrylate-maleic anhydride terpolymer (trade name, Bondine HX 8210, supplied by Sumika CDF Chemical Co., Ltd.) having an ethylene content of 91%, an ethyl acrylate content of 5.7% and a maleic anhydride content of 3.3% and having a Vicat softening point of 57° C. and a melting point of 100° C., whereby a toner for an electrostatic charge image was obtained and a two-component toner containing it was obtained.

EXAMPLE 3

Example 1 was repeated except that the ethylene-ethyl acrylate-maleic anhydride terpolymer was changed from 5 parts by weight of the Bondine HX8200 to 5 parts by weight of an ethylene-ethyl acrylate-maleic anhydride terpolymer (trade name "Bondine AX-8060", supplied by Sumika CDF Chemical Co., Ltd.) having an ethylene content of 69%, an ethyl acrylate content of 27.7% and a maleic anhydride content of 3.3% and having a Vicat softening point of 40° C. and a melting point of 68° C., whereby a toner for an electrostatic charge image was obtained and a two-component toner containing it was obtained.

COMPARATIVE EXAMPLE 1

Example 1 was repeated except that the ethylene-ethyl acrylate-maleic anhydride terpolymer was not used, whereby a two-component toner was obtained.

COMPARATIVE EXAMPLE 2

Example 1 was repeated except that 5 parts by weight of the Bondine HX 8200 as an ethylene-ethyl acrylate-maleic anhydride terpolymer was replaced with 5 parts by weight of a polyethylene wax (PE130, trade name, supplied by Hoechst Japan), whereby a two-component toner was obtained.

COMPARATIVE EXAMPLE 3

Example 1 was repeated except that 5 parts by weight of the Bondine HX 8200 as an ethylene-ethyl acrylate-maleic anhydride terpolymer was replaced with 5 parts by weight of carnauba wax, whereby a two-component toner was obtained.

COMPARATIVE EXAMPLE 4

Example 1 was repeated except that 5 parts by weight of the Bondine HX 8200 as an ethylene-ethyl acrylate-maleic anhydride terpolymer was replaced with 5 parts by weight of an ethylene-vinyl acetate copolymer, whereby a two-component toner was obtained.

COMPARATIVE EXAMPLE 5

Example 1 was repeated except that the amount of the Bondine HX 8200 as an ethylene-ethyl acrylate-maleic anhydride terpolymer was changed from 5 parts by weight to 0.5 part by weight, whereby a two-component toner was obtained.

COMPARATIVE EXAMPLE 6

Example 1 was repeated except that the amount of the Bondine HX 8200 as an ethylene-ethyl acrylate-maleic anhydride terpolymer was changed from 5 parts by weight to 35 parts by weight, whereby a two-component toner was obtained.

The two-component toners obtained in Examples 1 to 3 and Comparative Examples 1 to 6 were individually set in an electronic copying machine (SF-8800, supplied by Sharp Corp.), and copies were made continuously. These toners were evaluated on performances and properties as follows:

1) Preservation stability

A toner sample was allowed to stand under atmospheric pressure at 50° C. for 8 hours, and then evaluated with regard to its blocking according to the following grader, A: The toner sample showed no blocking after it had been allowed to stand under atmospheric pressure at 50° C. for 8 hours.

B: The toner sample showed a slight decrease in fluidity, but could be practically used without any problem.

C: The toner sample showed a decrease in fluidity and signs of blocking.

X: The toner caused blocking and could not be practically used.

XX: A toner caused extreme blocking.

2) Fixed residual ratio

The temperature of a fixing unit of the copying machine was set at 160° C., 180° C. or 200° C., and a fixed image (a solid image having a size of 1 cm×1 cm) was made. The fixed image was measured for an image density with a Macbeth densitometer. Then, the image portion was rubbed back and forth three times with an eraser abrasion tester at a pressure of 1 kg/cm$^2$, and the rubbed portion of the fixed image was measured for an image density with a Macbeth densitometer. The fixed residual ratio was determined by the following equation, $$\textit{Fixed residual ratio}\ (\%) = B/A \times 100$$

in which A is the image density before the rubbing and B is the image density after the rubbing.

3) Prevention of scumming in two-surface copying

A copy of an image was preliminarily made on one surface each of paper sheets (size A4, an image area ratio 5%), and these paper sheets were set in a multi-paper sheet cassette of the copying machine with the reverse surface (having no copied images) of each paper sheet upward. Ten out of these paper sheets were continuously fed to the copying machine to make an image on the reverse surface of each paper sheet, and that surface of each of the ten paper sheets which had already had the copied image was evaluated with regard to a state in which the copied image adhered to the surface of another paper sheet when abraded under a paper feeder roller pressure. The results were evaluated as follows:

A: No scumming

B: Scummed to a slight degree

C: Scummed

X: Considerably scummed

4) Image density and ground scumming

Measured with a Macbeth densitometer in an image portion and a non-image portion.

TABLE 1

| | PROPERTIES OF TONER FOR PRACTICAL USE | | | | | | | | |
|---|---|---|---|---|---|---|---|---|---|
| | | | | | | Initial image | | After 20,000 copies | |
| Sample from: | Preservation stability | Fixed residual ratio 160° C. | 180° C. | 200° C. | Scumming in two-surface copying | Image density | Ground scumming | Image density | Ground scumming |
| Ex. 1 | A | 65% | 75% | 88% | B | 1.33 | 0.50 | 1.34 | 0.56 |
| Ex. 2 | A | 64 | 79 | 89 | A | 1.32 | 0.52 | 1.33 | 0.62 |
| Ex. 3 | B | 67 | 82 | 93 | A | 1.34 | 0.54 | 1.34 | 0.50 |
| CEx. 1 | A | 55 | 64 | 72 | X | 1.34 | 0.55 | 1.34 | 0.73 |
| CEx. 2 | B–C | 59 | 70 | 74 | C | 1.07 | 0.99 | 1.01 | 1.03 |
| CEx. 3 | X | 61 | 70 | 79 | B–C | 1.28 | 0.76 | 1.31 | 1.05 |
| CEx. 4 | XX | 62 | 72 | 82 | A | 1.33 | 0.55 | 1.33 | 0.99 |
| CEx. 5 | A | 54 | 67 | 79 | X | 1.30 | 0.60 | 1.32 | 0.93 |
| CEx. 6 | XX | 63 | 76 | 90 | A | 1.34 | 0.58 | 1.33 | 0.88 |

As is clearly shown in Table 1, the toners obtained in Examples 1 to 3 according to the present invention had well-balanced properties with regard to their preservation stability and other properties for practical use.

In contrast, the toner obtained in Comparative Example 5 is an example of a toner in which the amount of the ethylene-ethyl acrylate-maleic anhydride based on the total toner weight is less than 1% by weight, and Table 1 shows that no effects were produced on the fixing properties (fixed residual ratio and prevention of a scumming in two-surface copying). Further, the toner obtained in Comparative Example 6 is an example of a toner in which the amount of the ethylene-ethyl acrylate-maleic anhydride based on the total toner weight is more than 30% by weight, and Table 1 shows that the preservation stability was extremely poor and practically unusable, although its fixing properties were excellent. The toners for an electrostatic charge image, obtained in Comparative Examples 1 to 4, are examples of toners which contain do not contain the ethylene-acrylic ester-maleic anhydride terpolymer introduced by the present invention, and Table 1 shows that these toners do not have any good balance with regard to their preservation stability and other properties for practical use.

EXAMPLES 4–7

Example 1 was repeated except that the amount of Bondine HX-8200 was changed to 1 part by weight (Example 4), 5 parts by weight (Example 5), 8 parts by weight (Example 6) and 11 parts by weight (Example 7), whereby two-component toners were obtained.

COMPARATIVE EXAMPLES 7 AND 8

Example 1 was repeated except that the amount of Bondine HX-8200 was changed to 15 parts by weight (Comparative Example 7) and 35 parts by weight (Comparative Example 8), whereby two-component toners were obtained.

The above two-component toners obtained in Examples 4 to 7 and Comparative Examples 7 and 8 were tested in the same manner as in Example 1 except for the preservation stability. Further, the two-component toners obtained in Examples 4 to 7 and Comparative Examples 7 and 8 were tested for preservation stability as follows.

A toner sample was charged into a 200 cc bottle formed of polyethylene, and the bottle was tightly sealed and allowed to stand in water bath at 50° C. for 8 hours. Then, the toner was taken out and placed in a drop amount tester (which will be described below) and measured for its drop amount for 5 minutes to examine the preservation stability of the toner.

Preservation stability = drop amount after standing/drop amount before standing × 100 (%)

A toner having a preservation stability of at least 80% can be practically used without any problem. A toner having a preservation stability of less than 80% shows phenomena of caking, blocking, etc., and causes a problem when put to practical use.

The above drop amount tester had a structure in which a roll whose surface was knurled was placed in the bottom of a container having a cross-sectional form of a reversed trapezoid and one side of the roll and the container were spaced to form a gap of 70 μm. The roll was rotated at 3 rpm, and the toner which was dropping through the gap was measured for an amount.

Table 2 shows the results.

TABLE 2

| | PROPERTIES OF TONER FOR PRACTICAL USE | | | | | | | | | | |
|---|---|---|---|---|---|---|---|---|---|---|---|
| | HX-8200 content | | Preservation stability*1 | Fixed residual ratio | | | Scumming in two-surface copying | Initial image | | After 20,000 copies | |
| | part by weight | % | (%) | 160° C. | 180° C. | 200° C. | | Image density | Ground scumming | Image density | Ground scumming |
| Ex. 4 | 1 | 0.87 | 95 | 56 | 68 | 79 | B | 1.32 | 0.52 | 1.35 | 0.59 |
| Ex. 5 | 5 | 4.22 | 92 | 65 | 75 | 88 | B | 1.33 | 0.50 | 1.34 | 0.56 |
| Ex. 6 | 8 | 6.58 | 89 | 67 | 79 | 92 | A | 1.33 | 0.55 | 1.36 | 0.60 |
| Ex. 7 | 11 | 8.84 | 83 | 67 | 80 | 94 | A | 1.35 | 0.51 | 1.33 | 0.72 |
| CEx. 7 | 15 | 11.68 | 76 | 65 | 76 | 93 | A | 1.33 | 0.60 | 1.35 | 0.89 |
| CEx. 8 | 35 | 23.58 | —*2 | 64 | 78 | 92 | A | 1.34 | 0.60 | 1.33 | 0.90 |

Notes:
*1test method as specified above.
*2Not measurable due to blocking.

What is claimed is:

1. A toner for an electrostatic charge image, which contains, as main components, a colorant and at least one binder resin selected from the group consisting of a styrene homopolymer and a styrene-based copolymer, and which further contains a charge control agent and from 1% by weight to less than 10% by weight, based on a total weight of the toner, of an ethylene-acrylic ester-maleic anhydride terpolymer resin, the terpolymer resin containing from 1% by weight to 40% by weight, based on the terpolymer resin, of an acrylic ester.

2. A toner according to claim 1, wherein the ethylene-acrylic ester-maleic anhydride terpolymer is composed of 1 to 40% by weight of acrylic ester, 55 to 98% by weight of ethylene and 1 to 5% by weight of maleic anhydride.

3. A toner according to claim 1, wherein the acrylic ester is an ester of a lower alkyl having 1 to 6 carbon atoms.

4. A toner according to claim 3, wherein the lower alkyl has 1 to 4 carbon atoms.

5. A toner according to claim 1, wherein the ethylene-acrylic ester-maleic anhydride terpolymer is contained in an amount of from 3% by weight to less than 10% by weight based on the total weight of the toner.

* * * * *